US011029085B2

(12) United States Patent
Ikeda

(10) Patent No.: US 11,029,085 B2
(45) Date of Patent: Jun. 8, 2021

(54) BOG PROCESSING APPARATUS

(71) Applicant: CHIYODA CORPORATION, Yokohama (JP)

(72) Inventor: Takeshi Ikeda, Yokohama (JP)

(73) Assignee: Chiyoda Corporation, Yokohama (JP)

( * ) Notice: Subject to any disclaimer, the term of this patent is extended or adjusted under 35 U.S.C. 154(b) by 617 days.

(21) Appl. No.: 15/559,363

(22) PCT Filed: Mar. 14, 2016

(86) PCT No.: PCT/JP2016/057921
§ 371 (c)(1),
(2) Date: Mar. 5, 2018

(87) PCT Pub. No.: WO2016/152608
PCT Pub. Date: Sep. 29, 2016

(65) Prior Publication Data

US 2018/0172345 A1 Jun. 21, 2018

(30) Foreign Application Priority Data

Mar. 20, 2015 (JP) ..... JP2015-057309

(51) Int. Cl.
*F25J 1/00* (2006.01)
*F17C 9/02* (2006.01)
*F17C 13/00* (2006.01)

(52) U.S. Cl.
CPC ..... *F25J 1/0025* (2013.01); *F17C 9/02* (2013.01); *F25J 1/0092* (2013.01); *F17C 13/00* (2013.01);
(Continued)

(58) Field of Classification Search
CPC ..... F25J 1/0025; F25J 1/0257; F25J 1/0258; F25J 1/0259; F17C 7/02; F17C 9/02;
(Continued)

(56) References Cited

U.S. PATENT DOCUMENTS 1,848,945 A * 3/1932 Genter ..... B01D 47/16 261/89
2,889,005 A * 6/1959 Umbricht ..... B01D 47/085 96/270
(Continued)

FOREIGN PATENT DOCUMENTS

CA 2586775 A1 * 5/2006 ..... F25J 1/0025
CA 2686134 A1 * 12/2008 ..... F17C 9/02
(Continued)

OTHER PUBLICATIONS

WO 2009104744 A1 (Year: 2009).*
(Continued)

*Primary Examiner* — Len Tran
*Assistant Examiner* — Jenna M Hopkins
(74) *Attorney, Agent, or Firm* — Quarles & Brady LLP

(57) ABSTRACT

The present invention is to provide a BOG processing apparatus. The BOG processing apparatus includes a cooling device, a second cooling device, and a recovery device. The cooling device has a cooling drum, a BOC inlet part introducing the BOG, a first spray spraying LNG in an upward direction, a first filled layer contacting with the LNG and the BOG, a second spray spraying the LNG in a downward direction, a third spray spraying the LNG in a downward direction, a second filled layer adsorbing mist in the BOG, and a mist eliminator eliminating the mist in the BOG.

11 Claims, 3 Drawing Sheets

(52) U.S. Cl.
CPC ..... *F17C 2201/0109* (2013.01); *F17C 2205/0323* (2013.01); *F17C 2221/033* (2013.01); *F17C 2227/0135* (2013.01); *F17C 2227/0157* (2013.01); *F17C 2227/0339* (2013.01); *F17C 2265/032* (2013.01); *F17C 2265/033* (2013.01)

(58) Field of Classification Search
CPC ..... F17C 2265/03; F17C 2265/031; F17C 2265/032; F17C 2265/033; F17C 2265/034; F17C 2265/0339
See application file for complete search history.

(56) References Cited

U.S. PATENT DOCUMENTS 2,938,360 A * 5/1960 Christensen ..... F17C 13/02 62/48.2
3,714,790 A * 2/1973 Battey ..... B01D 5/003 62/48.2
3,733,838 A * 5/1973 Delahunty ..... F25J 1/0025 62/48.2
3,738,353 A * 6/1973 Santoleri ..... F17C 9/02 122/32
3,897,194 A * 7/1975 von Wiesenthal ..... F17C 9/02 431/11
3,947,258 A * 3/1976 Decker ..... B01D 1/00 95/229
3,981,156 A * 9/1976 Modisette ..... B01D 53/1487 62/48.2
4,157,250 A * 6/1979 Regehr ..... B01D 47/06 55/424
4,475,928 A * 10/1984 Jacobsen ..... C10G 5/04 95/17
4,637,216 A * 1/1987 Shenoy ..... F25J 1/0005 62/116
5,156,006 A * 10/1992 Broderdorf ..... A23L 3/362 62/121
5,230,725 A * 7/1993 Chowaniec ..... B01D 45/16 55/440
5,486,318 A * 1/1996 McKeigue ..... B01D 3/141 261/112.2
5,570,644 A * 11/1996 Cheng ..... F23J 15/04 110/215
5,635,149 A * 6/1997 Klingspor ..... B01D 53/501 423/243.08
5,649,427 A * 7/1997 Sawada ..... A63J 5/025 62/48.1
5,649,433 A * 7/1997 Suzuki ..... F17C 3/08 62/620
5,672,323 A * 9/1997 Bhat ..... B01D 53/02 422/172
5,925,291 A * 7/1999 Bharathan ..... F28B 3/02 261/112.2
5,956,971 A * 9/1999 Cole ..... F25J 1/0202 62/623
6,083,302 A * 7/2000 Bauver, II ..... B01D 45/08 55/440
6,190,620 B1 * 2/2001 Shinoda ..... B01D 53/504 422/171
6,470,706 B1 * 10/2002 Engdahl ..... B01D 5/003 62/614
6,500,240 B1 * 12/2002 Tomimatsu ..... B03C 3/013 239/690
6,605,263 B2 * 8/2003 Alix ..... B01D 53/60 423/243.06
6,745,576 B1 * 6/2004 Granger ..... F17C 5/06 62/48.2
7,310,971 B2 * 12/2007 Eaton ..... F25J 1/0258 165/166
7,326,286 B2 * 2/2008 Okada ..... B01D 53/504 96/271
7,484,384 B2 * 2/2009 Nanda ..... B01D 5/0003 62/48.2
7,493,778 B2 * 2/2009 Engdahl ..... F17C 5/06 62/48.2
8,028,724 B2 * 10/2011 Lee ..... F17C 1/12 141/11
8,065,883 B2 * 11/2011 Pozivil ..... F17C 13/026 62/50.1
8,591,273 B2 * 11/2013 Nylund ..... F02M 21/0215 440/88 F
8,673,227 B2 * 3/2014 Black ..... B01D 53/1406 422/168
8,784,761 B2 * 7/2014 Dube ..... B01D 53/1406 423/234
9,638,373 B2 * 5/2017 Zhai ..... F17C 3/08
9,927,068 B2 * 3/2018 Mak ..... F25J 1/0025
10,508,769 B2 * 12/2019 Lee ..... F17C 1/002
2002/0167564 A1 * 11/2002 Chou ..... B41J 2/1404 347/40
2003/0080212 A1 * 5/2003 McCracken ..... B05B 1/265 239/427.3
2005/0126220 A1 * 6/2005 Ward ..... F25J 3/0403 62/625
2006/0042312 A1 * 3/2006 Winningham ..... F25J 3/0238 62/620
2006/0185517 A1 * 8/2006 Nagel ..... B01D 53/1406 96/275
2007/0068176 A1 * 3/2007 Pozivil ..... F17C 13/026 62/45.1
2009/0092529 A1 * 4/2009 Ghosh ..... B01D 53/504 423/235
2009/0100844 A1 * 4/2009 Rummelhoff ..... F25J 1/0025 62/48.2
2009/0266086 A1 * 10/2009 Lee ..... F17C 9/02 62/48.1
2011/0185748 A1 * 8/2011 Fuchs ..... F17C 9/02 62/50.2
2011/0203456 A1 * 8/2011 Hakansson ..... F01N 3/0871 95/224
2011/0220003 A1 * 9/2011 Colmard ..... F17C 13/004 114/74 R
2013/0333799 A1 * 12/2013 Chang ..... F17C 5/02 141/39
2014/0026753 A1 * 1/2014 Hakansson ..... B01D 3/008 95/210
2015/0101485 A1 * 4/2015 Laslo ..... B01D 47/06 95/224
2015/0114315 A1 * 4/2015 Lippsmeyer ..... F22B 1/16 122/15.1
2015/0330576 A1 * 11/2015 Zhai ..... F17C 3/08 220/560.12
2016/0114876 A1 * 4/2016 Lee ..... F02C 3/22 60/39.465
2016/0215930 A1 * 7/2016 Nelson ..... F17C 9/02
2019/0001261 A1 * 1/2019 Tsujiuchi ..... B01D 53/62

FOREIGN PATENT DOCUMENTS

DE 732138 C * 2/1943 ..... F17C 9/00
EP 1956285 A2 * 8/2008 ..... F17C 13/004
GB 2099566 A * 12/1982 ..... F23J 15/06
JP 3623283 B1 12/1961
JP 54096819 A * 7/1979 ..... F17C 13/025
JP S5733298 A 2/1982
JP S5751098 A 3/1982
JP 59019799 A * 2/1984 ..... F17C 9/04
JP H05279677 A 10/1993
JP H068900 U 2/1994
JP H068900 Y2 * 3/1994
JP 2001254898 A 9/2001
JP 2003227608 A 8/2003
JP 2004076825 A * 3/2004
JP 2007155060 A 6/2007
JP 2009191945 A 8/2009
JP 2012122554 A * 6/2012
JP 2012122554 A 6/2012
JP 2013155879 A * 8/2013

(56) References Cited

FOREIGN PATENT DOCUMENTS

| | | | | |
|---|---|---|---|---|
| KR | 101278144 | B1 * | 6/2013 | |
| WO | WO-2005047761 | A1 * | 5/2005 | ..... F25J 1/0288 |
| WO | WO-2008085348 | A2 * | 7/2008 | ..... F17C 9/02 |
| WO | WO-2011053164 | A1 * | 5/2011 | ..... B63H 21/38 |
| WO | WO-2013032340 | A1 * | 3/2013 | ..... F02M 21/0287 |
| WO | WO-2014121579 | A1 * | 8/2014 | ..... F17C 3/08 |
| WO | WO-2016076038 | A1 * | 5/2016 | ..... B05B 1/26 |

OTHER PUBLICATIONS

PCT International Search Report, PCT/JP2016/057921, dated Jun. 14, 2016, 4 pages.
PCT International Preliminary Report on Patentability, PCT/JP2016/057921, dated Sep. 26, 2017, 9 pages.

* cited by examiner

BOG PROCESSING APPARATUS

CROSS-REFERENCE TO RELATED APPLICATIONS

This application represents the national stage entry of PCT International Application No. PCT/JP2016/057921 filed Mar. 14, 2016 and claims priority to Japanese Patent Application No. 2015-057309 filed Mar. 20, 2015. The contents of these applications are hereby incorporated by reference as if set forth in their entirety herein.

BACKGROUND OF THE INVENTION

Technical Field

The present invention relates to a BOG processing apparatus for processing boil-off gas generated from liquefied gas.

Background Art

Conventionally, in a manufacturing facility of liquefied gas (liquefied natural gas, liquefied petroleum gas and so on), storage equipment thereof, and receiving equipment thereof, liquefied gas is stored in a storage tank, drawn from the storage tank, and sent to next processes (a transportation process or a supply process). In such storage tanks of liquefied gas, boil-off gas (BOG) is generated due to vaporization of liquefied gas. As processing measures of such BOG, there are various methods such as a method of delivering it to a utilizing system so as to directly consume it as fuel, a method of re-liquefying the BOG and then returning it to the storage tank, a method of re-liquefying the BOG and mixing it with the liquefied gas, and so on. As a re-liquefying method of the BOG, various methods (for example, see Patent Literatures 1 to 4) are proposed such as a method of cooling the BOG using cool heat of the liquefied gas. Thereby, the re-liquefied BOG liquid and the BOG vapor are separated, and the vapor-liquid is processed.

In the BOG processing method described in Patent Literature 1, BOG is introduced to the BOG drum, the LNG taken out from LNG tank is injected to the inside of the BOG drum, the BOG is cooled by contacting with the LNG, and thereby the BOG is liquefied. The liquefied BOG is returned from the BOG drum to the LNG tank as a mixed liquid mixed with the LNG. Meanwhile, the BOG cooled by contacting with the LNG is transmitted from a tip portion of the BOG drum to the BOG compressor, and delivered to a utilizing system after compressed with the BOG compressor.

In the BOG processing method described in Patent Literature 2, a mist separation apparatus is provided in the middle of the BOG pipe arranged from the LNG tank to the BOG compressor. Mist is separated from the BOG by a liquid drain drum of the mist separation apparatus. The separated mist is pressurized and sent from a drain pipe arranged on a lower portion of the liquid drain drum to the LNG tank via a drain pump, and returned by spraying it into the LNG tank. On the other hand, the BOG passed through the mist separation apparatus is sent from the BOG discharge pipe to the BOG compressor, and then compressed. Therefore, the BOG passed through the mist separation apparatus is supplied to the utilizing system such as a thermal power device connected to downstream thereof. The liquid drain drum introduces the BOG into an inner space thereof, settles out mist downward by reducing its flow velocity, and thereby drains liquid. Above the inside of the liquid drain drum, a mist eliminator having a mesh filter is arranged. Mist which was not settled out brings into contact with the mesh filter, is taken, and is separated.

In the BOG processing method described in Patent Literature 3, BOG is compressed with a compressor, then cooled with a cooler, and supplied to a mixing drum. Further, a part of the LNG is decompressed, and then sprayed into the mixing drum. Thereafter, a mist-shaped LNG by injecting and BOG are contacted, and thereby BOG is re-liquefied. BOG not re-liquefied is returned from a blower line to the compressor. On the other hand, the mixed liquid in which the re-liquefied BOG and LNG are mixed is re-sprayed on the mixed drum, or supplied to the cooler by pressure rising. Thereafter, the mixed liquid is merged to LNG from the LNG tank, supplied to a carburetor, vaporized, and then sent to the utilizing system.

In a BOG processing method described in Patent Literature 4, BOG generated in a storage tank is compressed with a compressor, and then sent to a reliquefying device. Further, liquefied gas taken from the storage tank is supplied to the reliquefying device, and BOG is re-liquefied by heat exchanging with the liquefied gas. The mixed liquid in which BOG re-liquefied with the reliquefying device and liquefied gas are mixed is sent to an heat exchanger via a pump, and sent to a carburetor after utilizing the mixed liquid in the heat exchanger so as to cool BOG as a cooling medium. Thereafter, the mixed liquid is supplied to a utilizing system as liquefied gas vaporized in the carburetor.

Patent Literature 1: JP 1105-279677 A
Patent Literature 2: JP 2001-254898 A
Patent Literature 3: JP 2007-155060 A
Patent Literature 4: JP 2009-191945 A

SUMMARY OF THE INVENTION

Technical Problem

In a manufacturing facility of liquefied gas, storage facilities thereof, and a receiving facility thereof, the generation amount of BOG generated in the storage tank is not constant, but greatly varies. For this reason, equipment design which can respond to the maximum amount of BOG is required. On the other hand, demand for gas in the utilizing system is further not constant, but also supply of liquefied gas taken from the storage tank greatly varies. Therefore, when sending BOG (re-liquefied BOG) to the utilizing system after joined to the liquefied gas, the consumption of BOG is not stabilized, and extra equipment design is needed to balance the amount of BOG and the consumption. However, in the conventional BOG processing method described in Patent Literatures 1-4, equipment deign that is able to respond to the maximum amount of BOG, and to balance the amount of BOG and the consumption is not sufficiently taken into consideration. Further, when trying to perform such design, specifications of each of equipment becomes excessive, and excessive energy is required for the operation of equipment.

An object of the present invention is to provide a BOG processing apparatus which can cut waste of each of apparatus and to improve energy efficiency of apparatus operation.

Solution to Problem

A BOG processing apparatus of the present invention for processing boil-off gas (BOG) generated from liquefied gas includes a cooling device for cooling the BOG by cold energy of the liquefied gas; and a recovery device for recovering a remaining liquid of the liquefied gas remaining for use in cooling by the cooling device, or a mixed liquid in which liquid of the BOG cooled and liquefied by the cooling device and the liquefied gas are mixed. The cooling device includes a cooling drum formed in a cylindrical shape extending up and down, and circulating BOG from below to above; a BOG inlet part introducing the BOG from a lower portion of the cooling drum into an inside of the cooling drum; a first spray provided above the BOG inlet part and upwardly spraying the liquefied gas; a first filled layer provided above the first spray and bringing the liquefied gas into contact with the BOG; a second spray provided above the first filled layer and downwardly spraying the liquefied gas; a BOG outlet part provided in an upper portion of the cooling drum and sending the BOG cooled; and a liquid outlet part provided in the lower portion of the cooling drum and sending the remaining liquid or the mixed liquid to the recovery device.

According to the present invention as described above, the cooling device has the cooling drum, and the BOG inlet part, the first spray, the first filled layer, and the second spray are arranged inside of the cooling drum in order. Therefore, contact efficiency between liquefied gas in the first filled layer and BOG can be improved. That is, liquefied gas is sprayed to BOG introduced from the lower portion of the cooling drum and flowing upwardly, and liquefied gas is sprayed downwardly from the second spray. Thereby, liquefied gas is spread on the top and bottom of the first filled layer positioned between the first spray and the second spray, and BOG passing through the first filled layer can bring into contact with much liquefied gas. Therefore, a predetermined cooling performance for cooling BOG (or for further re-liquefying BOG) can be maintained, the thickness of the first filled layer can be decreased, and the amount of liquefied gas sprayed from each of the sprays can be reduced.

Further, it is preferable that the BOG processing apparatus of the present invention further includes a third spray provided above the second spray and downwardly spraying the liquefied gas; a second filled layer provided above the third spray and adsorbing mist in BOG; and a mist eliminator provided above the second filled layer and eliminating mist in BOG passing through the second filled layer. Preferably, the third spray sprays the liquefied gas with a mist form in which liquid drop is small compared with the second spray.

According to the above structure, the third spray, the second filled layer, and the mist eliminator are arranged above the second spray in the inside of the cooling drum in this order. Further, the third spray sprays liquefied gas having a mist shape in which liquid drop is smaller than that of second spray. Therefore, cooling performance for cooling BOG and controlling BOG temperature (or further re-liquefying BOG) can be improved. Furthermore, mist in BOG is adsorbed by the second filled layer arranged above the third spray, and mist in BOG passing through the second filled layer is removed by the mist eliminator. Thereby, BOG in which mist is not included as much as possible can be delivered from the BOG outlet part. When the compressor is provided above the BOG outlet part, BOG can be compressed without decreasing performance of the compressor.

Further, in the BOG processing apparatus of the present invention, it is preferable that the recovery device includes an ejection introducing the liquefied gas, drawing the remaining liquid or the mixed liquid by injection pressure of the liquefied gas, and mixing the liquefied gas and the remaining liquid or the mixed liquid and delivering.

According to the above structure, the recovery device includes an ejection. The ejection draws the remaining liquid or the mixed liquid from the liquid outlet part of the cooling drum by injection pressure of liquefied gas, and delivers it. Therefore, liquid can be recovered without using a pump driven by external power, and configuration of the device can be simplified. Herein, when the recovery device is constructed by using driving components such as a pump or valve for sending liquid, it is necessary to use driving components of cryogenic specification. Further, installation of driving components of a plurality of systems is required in maintenance or failure. As a result, the recovery device is complexed, becomes large in size, and thereby cost of the installation is increased. In contrast, in the present invention, the recovery device is constructed with the ejector for using pressure of liquefied gas. Therefore, it is not necessary to use driving components such as a pump or valve, and thereby structure of the recovery device can be simplified, and decreased in size. Further, cost of equipment can be reduced.

According to the BOG processing apparatus of the present invention as described above, a predetermined cooling performance for cooling BOG (or cooling and re-liquefying) can be kept, and the amount of liquefied gas for spraying can be reduced. Therefore, waste of each device can be eliminated, and energy efficiency of device operation can be increased.

DESCRIPTION OF THE PREFERRED EMBODIMENT

Hereinafter, an embodiment of the preset invention will be explained with reference to drawings. A BOG processing apparatus 1 of the embodiment of the present invention for example is installed in a manufacturing equipment of liquefied natural gas (LNG), a storage equipment thereof, a receiving equipment thereof and so on, and processes Boil-off gas (BOG) caused by vaporizing LNG in a LNG storage tank. The BOG processing apparatus 1 is constructed to cool the BOG and returns the remaining liquid (or the mixed liquid including the re-liquefied liquid) to the LNG storage tank, and to send BOG to a utilizing system. Herein, as the utilizing system, a thermal power equipment for burning BOG as a fuel gas so as to generate electric power is illustrated.

Figure 1:
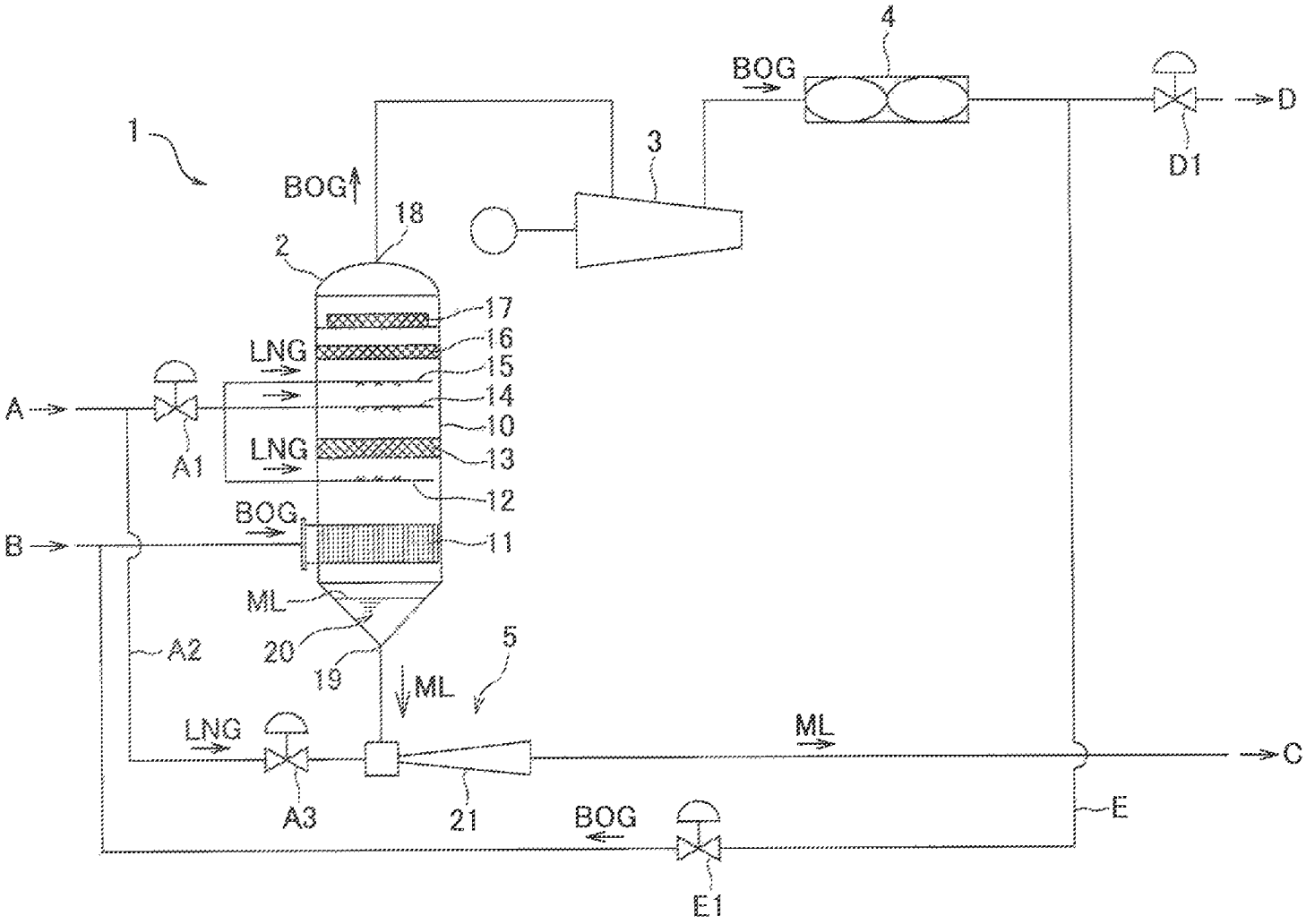
FIG. 1 is a schematic configuration showing a BOG processing apparatus according to an embodiment of the present invention.

As shown in FIG. 1, in the BOG processing apparatus 1, a LNG supply line A for supplying LNG from the LNG storage tank, a BOG supply line B for supplying BOG from the LNG storage tank, a liquid return line C for returning liquid remaining in the treatment (or the mixed liquid in which the re-liquefied BOG and LNG are mixed, hereafter it is simply described as liquid ML) to the LNG storage tank, and a BOG outlet line D for delivering the processed BOG to the utilizing system are connected. LNG which is extracted from a lower portion of the LNG storage tank and boosted by a pump is supplied via a flow control valve A1 to the LNG supply line A. Further, BOG which is extracted from an upper portion of the LNG storage tank, boosted by a compressor, and cooled by a precooling apparatus is supplied to the BOG supply line B.

Figure 3:
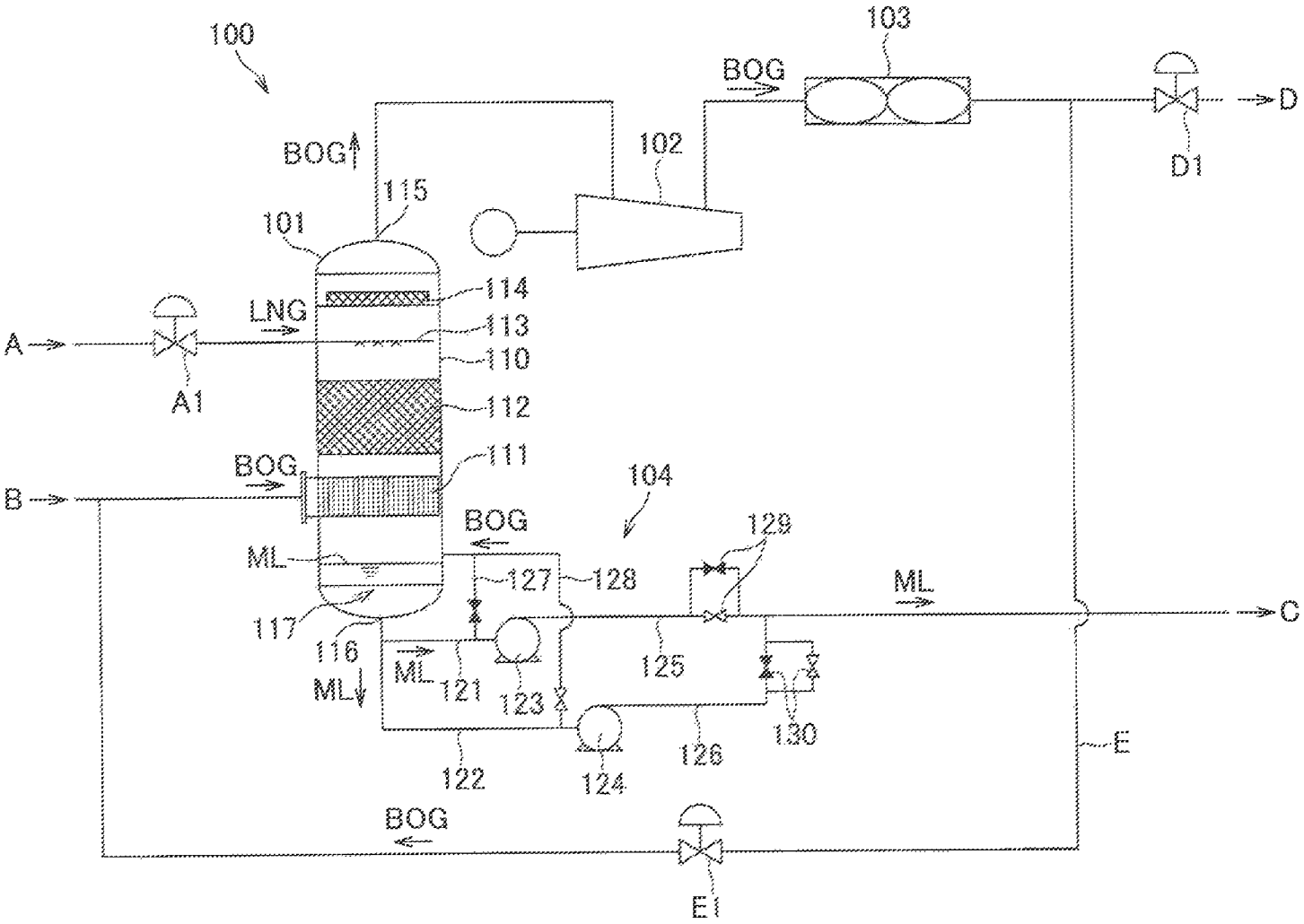
FIG. 3 is a schematic configuration showing a BOG processing apparatus before improving the present invention.

Herein, a BOG processing apparatus 100 before the improvement having substantially the same function as the BOG processing apparatus 1 of the embodiment in the present invention will be explained with reference to FIG. 3. In the BOG processing apparatus 100, as well as the BOG processing apparatus 1, a LNG supply line A, a BOG supply line B, a liquid return line C, and a BOG outlet line D are connected. The BOG processing apparatus 100 has a cooling device 101 for cooling BOG by cool heat of LNG, a compression device 102 for compressing BOG cooled by the cooling device 101, a second cooling device 103 for cooling BOG compressed by the compression device 102, and a recovery device 104 for recovering the remaining liquid (or the mixed liquid in which re-liquefied BOG liquid and LNG are mixed) ML remaining after used in the cooling device 101 so as to cool BOG.

The cooling device 101 has a cooling drum 110, a BOG inlet part 111, a filled layer 112, a spray 113, a mist eliminator 114, a BOG outlet part 115, and a liquid outlet part 116. The cooling drum 110 is formed in a cylindrical shape extending vertically, and circulates BOG from below to above. The BOG inlet part 111 introduces BOG from a lower portion of the cooling drum 110 into an inside thereof. The filled layer 112 is arranged above the BOG inlet part 111, and brings LNG into contact with BOG. The spray 113 is arranged above the filled layer 112, and sprays LNG downwardly. The mist eliminator 114 is arranged above the spray 113, and eliminates mist in BOG. The BOG outlet part 115 is arranged above the cooling drum 110, and ejects the cooled BOG toward the compression device 102. The liquid outlet part 116 is arranged in a lower side of the cooling drum 110, and ejects liquid ML toward the recovery device 104.

The cooling drum 110 is formed as a close container. In an inside of the cooling drum 110, the BOG inlet part 111, the filled layer 112, the spray 113, and the mist eliminator 114 are installed. In a lower portion of the cooling drum 110, a storage part 117 is arranged so as to store liquid ML, and is formed with a semi-ellipsoid shape of 2 to 1. The BOG inlet part 111 is constructed with a current plate for evenly diffusing BOG supplied from the BOG supply line B into an inside of the cooling drum 110. BOG introduced from the BOG inlet part 111 rises in the inside of the cooling drum 110, and passes through the filled layer 112 and the mist eliminator 114.

The filled layer 112 is a layer for cooling BOG (or re-liquefying a part of BOG by cooling) with cool heat of LNG after coming into gas-liquid contact with BOG introduced from the BOG inlet part 11 into the inside of the cooing drum 110 and LNG sprayed from the spray 113. Further, in order to bring LNG and BOG into gas-liquid contact with a large contact area, the filled layer 112 is constructed by one for example filled with a metal forming ring or one formed by overlapping a net-like molded body made of metal, and is formed in a layer shape with a height dimension of about 2 m. The mist eliminator 114 removes the mist from BOG raised with a gas state through the filled layer 112, and is constructed with a metal or ceramic filter having fine meshes so as to absorb mist and drop it.

The compression device 102 compresses BOG which is cooled by the cooling device 101 and introduced from the BOC outlet part 115. For example, a turbo type compressor is used for the compression device 102. The second cooling device 103 cools BOG boosted by the compression device 102. For example, an air-cooling type air fin cooler is used for the second cooling device 103. Herein, while BOG introduced from the BOG outlet part 115 is cooled to for example −100° C. to −120° C., and raised to 60° C. to 70° C. by compressed with the compression device 102, it is delivered to the utilizing system after cooled to normal temperature of approximately 30° C. by the second cooling device 103.

In the BOG outlet line D for delivering BOG to the utilizing system, a BOG valve D1 is provided so as to control flow rate depending on demand of BOG in the utilizing system and to close circulation of BOG. In an upstream side than the BOG valve D1 (a side of the second cooling device 103), a BOG circulation line E is connected. The BOG circulation line E is to connect the BOG outlet line D and the BOG supply line B. In the middle of the BOG circulation line E, a BOG valve E1 is arranged so as to control flow rate of BOG circulating BOG into the BOG supply line B and to close circulation of BOG. That is, when demand of BOG is low in the utilizing system, the BOG valve D1 is throttled, the BOG valve E1 is opened, and BOG from the BOG circulation line E to the BOG supply line B is circulated. Thereby, the delivery from the compression device 102 to the BOG outlet line D is reduced, and BOG circulating from the cooling device 101 to the compression device 102 is increased. As a result, the operation of the compression device 102 can be performed without delay.

The recovery device 104 extracts liquid ML stored in the storage part 117 of the cooling drum 110, and returns the extracted liquid ML to the LNG storage tank through the liquid return line C. The recovery device 104 has extraction pipes 121, 122 connected to the liquid outlet part 116 of the cooling device 101 and divided into two system, pumps 123, 124 arranged in each of the extraction pipes 121, 122, and pipes 125, 126 extending from each of the pumps 123, 124 to the liquid return line C. In the extraction pipes 121, 122, gas pipes 127, 128 for returning BOG vaporized from liquid ML to the cooling drum 110 are connected. Furthermore, in the middles of the pipes 125, 126, a pair of switching valves 129, 130 for switching flow of liquid ML and adjusting flow rate thereof are arranged, respectively.

In such recovery device 104, the switching valves 129, 130 is switched, and one of the pumps 123 and 124 is driven. Thereby, liquid ML is extracted from the cooling drum 110 by using a path on one side, and delivered to the liquid return line C. At this time, although the other of the pumps 123 and 124 is stopped, a small amount of liquid ML flows through a path on the other side by the switching valves 129, 130. In the other words, liquid ML is delivered in the path of the one side, and the path of the other side is made to wait as a backup. By switching between one side and the other side appropriately, maintenance and equipment exchange can be performed without stopping the operation. Further, by draining a small amount of liquid ML to the path of the other side standing-by and cooling liquid ML, an available state is always maintained on the path of the other side.

As described above, according to the BOG processing apparatus 100 before the improvement, liquid of LNG remaining after used in the cooling device 101 for cooling (or the mixed liquid in which the re-liquefied BOG and LNG are mixed) as liquid ML can be returned to the LNG storage tank via the liquid return line C. Further, mist from BOG cooled by the cooling device 101 is eliminated, and BOG is compressed by the compression device 102, and cooled by the second cooling device 103. Thereafter, BOG can be sent to the utilizing system as a fuel gas via the BOG outlet line D. Therefore, BOG generated in the LNG storage tank can be effectively utilized without waste.

However, in the BOG processing apparatus 100 before the improvement, the filled layer 112 for bringing into gas-liquid contact with BOG and LNG and cooling BOG by cool heat of LNG becomes excessive in the cooling device 101. Further, LNG sprayed from the spray 113 tends to become large amounts. That is, BOG introduced from the BOG inlet part 111 lower than the filled layer 112 comes into gas-liquid contact with LNG sprayed from the spray 113 upper than the filled layer 112. In order to increase the contact area, a thickness dimension of the filled layer 112 becomes large, and thereby the supply of LNG for spraying is increased so as to spread LNG to the thick filled layer 112. In this manner, when the supply of LNG is increased, operation power of the pump used for supplying is increased. As a result, problem such that operation energy of the entire system is increased is caused.

Further, in the BOG processing apparatus 100 before the improvement, two systems of piping and pumps 123, 124 for operation and backup are installed in the recovery device 104 from the need for continued operation. Therefore, installation of equipment and maintenance become a major liability. Furthermore, two systems of piping, valves, and pumps 123, 124 are used for circulating the remaining LNG liquid ML (or the mixed liquid in which the re-liquefied BOG and LNG are mixed). For this reason, it is necessary to use a cryogenic equipment. Therefore, installation burden of equipment is increased. In addition, since flowing a small amount of liquid ML in a path on a stand-by side as its backup and cooling are required, energy used for the operation is increased. In this manner, in the BOG processing apparatus 100 before the improvement, problem that not only burdens of installation of equipment and maintenance in the recovery device 104 is increased but also energy for used for the operation is increased is caused.

Figure 2:
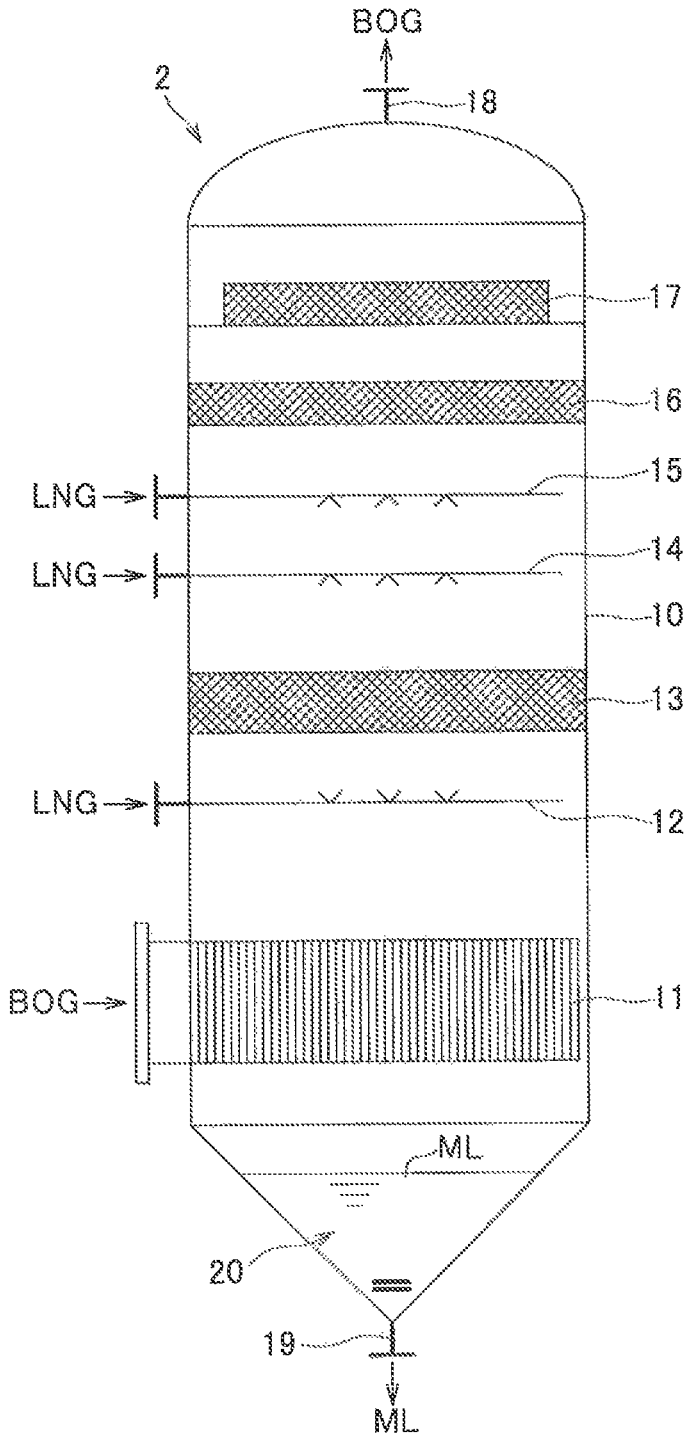
FIG. 2 is a sectional view showing a cooling device in the BOG processing apparatus.

For the BOG processing apparatus 100 before the improvement as described above, the improved point will be explained in detail below with reference to FIGS. 1 and 2. A BOG processing apparatus 1 is constructed with a cooling device 2, a compression device 3, a second cooling device 4, and a recovery device 5. In the BOG processing apparatus 1, the cooling device 2 and the recovery device 5 are improved from the cooling device 101 and the recovery device 104 of the BOG processing apparatus 100. The compression device 3 and the second cooling device 4 are used in the same manner as the compression device 102 and the second cooling device 103.

The cooling device 2 has a cooling drum 10, a BOG inlet part 11, a first spray 12, a first filled layer 13, a second spray 14, a third spray 15, a second filled layer 16, and a mist eliminator 17. The cooling drum 10 is formed in a cylindrical shape extending up and down, and circulates BOG from below to above. The BOG inlet part 11 introduces BOG from a lower portion of the cooling drum 10 into an inside of the cooling drum 10. The first spray 12 is arranged above the BOG inlet part 11, and upwardly spraying LNG. The first filled layer 13 is arranged above the first spray 12, and brings into contact with LNG and BOG. The second spray 14 is arranged in au upper side of the first filled layer 13, and downwardly sprays LNG. The third spray 15 is arranged above the second spray 14, and downwardly sprays LNG. The second filled layer 16 is arranged above the third spray 15, and adsorbs mist in BOG. The mist eliminator 17 is arranged above the second filled layer 16, and eliminates mist in BOG. Further, in an upper portion of the cooling drum 10, a BOG outlet part 18 for sending BOG toward the compression device 3 is arranged. In a lower portion of the drum 10, a liquid outlet part 19 for sending liquid ML toward the recovery device 5 is arranged.

The cooling drum 10 is formed as a closed container. The BOG inlet part 11, the first spray 12, the first filled layer 13, the second spray 14, the third spray 15, the second filled layer 16, and the mist eliminator are installed inside of the cooling drum 10. Further, a storage part 20 for storing liquid ML in which LNG and BOG are mixed is formed in a lower portion of the cooling drum 10. The storage part 20 is formed in a substantially conical shape projecting downward so as to store mixed liquid ML. The 130G inlet part 11 is constructed with a current plate for evenly diffusing BOG supplied from the BOG supply line B into an inside of the cooling drum 10 in common with the BOG inlet part 111. BOG introduced from the BOG inlet part 11 moves up inside of the cooling drum 10, and passes through the first filled layer 13, the second filled layer 16, and the mist eliminator 17.

The first spray 12 sprays LNG upwardly. That is, the first spray 12 sprays LNG along flow of BOG introduced from the BOG inlet part 11 and moving up, and LNG is upward moved toward the first filled layer 13 while including BOG in LNG. The first filled layer 13 is formed in a layer shape overlapping a metal ring or metal net similar to the filled layer 112. The first filled layer 13 is different from the filled layer 112. For example, the height dimension thereof is thinly made with about 600 mm. In common with the spray 113, the second spray 14 downwardly sprays LNG, but LNG sprayed from the second spray 14 is greatly reduced than the spray 113. The third spray 15 sprays mist-like LNG having a small droplet diameter compared with the second spray 14.

In this manner, by coming into gas-liquid contact with LNG which is sprayed from each of the first spray 12, the second spray 14 and the third spray 15 and BOG introduced from the BOG inlet part 11, BOG is cooled by cold energy of LNG (or a part of BOG is re-liquefied by cooling). When passing through the second filled layer 16, mist is adsorbed on BOG cooled by the first filled layer 13 and rising as a vapor. Further, when passing through the mist eliminator 17, mist is removed and sent from the BOG outlet part toward the compression device 3. Liquid ML of the first filled layer 13 falls into the lower storage part 20 and is stored.

In common with the first filled layer 13, the second filled layer 16 is constructed with in the form of laminate overlapping a metal forming ring or a metal mesh shaped body, but the size of the ring or mesh is formed smaller than the first filled layer 13. Thereby, the second filled layer 16 is configured to facilitate adsorption of mist. Further, in common with the mist eliminator 114, the mist eliminator 17 is constructed with metal or ceramic having fine mesh so as to adsorb mist in BOG and drop it. In this way, mist of LNG adsorbed on the second filled layer 16 and the mist eliminator 17 are combined and then the drop become large. Thereby, the mist falls into the lower side of storage part 20 and stored with liquid ML.

The recovery device 5 extracts liquid ML stored in the storage part 20 of the cooling drum 10, and returns the extracted liquid ML from the liquid return line C to the LNG storage tank. The recovery device 5 is constructed with an ejector 21 connected to the liquid outlet part 19 of the cooling device, a branch pipe A2 connecting the front of the flow control valve A1 on the LNG supply line A with the ejector 21, and a control valve A3 arranged on a middle of the branch pipe A2 and controlling flow rate of LNG. The ejector 21 introduces liquid ML extracted from the liquid outlet part 19 into an inside thereof, and draws liquid ML by injection pressure of LNG supplied from the branch pipe A2. Further, the ejector 21 apples pressure after mixing LNG and liquid ML, and sends the liquid ML from the liquid return line C to the LNG storage tank.

According to such recovery device 5, liquid ML can be drawn by the injection pressure of LNG supplied from the LNG storage tank without using the pumps 123, 124, and can be sent from the liquid return line C to the LNG storage tank. Therefore, power for driving the pumps and so on can be reduced. Further, by using LNG as a driving medium and returning liquid ML to the LNG storage tank, energy efficiency of the whole BOG processing process can be boosted without adding a separation apparatus required when using another driving medium.

According to the BOG processing apparatus 1 of the embodiment in the present invention as described above, there are effects as below. More specifically, while BOG is introduced from the lower portion of the cooling drum 10 and flows upward, LNG is upwardly sprayed from the first spray 12 along a direction in which BOG flows, and is downwardly sprayed from the second spray 14. Thereby, LNG can be spread on the top and lower of the first filled layer 13 positioned between the first spray 12 and the second spray 14, and BOG passing through the first filled layer 13 can be brought into contact with much LNG. Thus, a predetermined cooling performance for cooling BOG (or cooling and re-liquefying BOG) can be maintained, and a thickness in the first filled layer 13 can be decreased. Furthermore, an amount of LNG sprayed from each of the sprays 12, 14 can be reduced by the minimum necessary.

The third spray 15 is arranged upward the second spray 14, LNG having a mist shaped is sprayed from the third spray 15, and thereby cooling performance for cooling BOG (or cooling and re-liquefying BOG) can be improved. Further, mist in BOG is adsorbed by the second filled layer 16 arranged upward the third spray 15, and mist in BOG passing through the second filled layer 16 is eliminated by the mist eliminator 17. Therefore, BOG in which mist is not included as much as possible can be sent from the BOG outlet part 18 to the compression device 3, and BOG can be compressed without reducing the function of the compression device 3.

Further, the recovery device 5 has the ejector 21 in which LNG becomes the driving medium. Therefore, when compared with a case of using driving components the pumps 123, 124 or valves 129, 139 like the BOG processing apparatus before the improvement, the structure of the recovery device 5 can be simplified and downsized. Furthermore, cost of equipment can be reduced. That is, in the BOG processing apparatus 100 before the improvement, it is necessary to use cryogenic driving components such as the pumps 123, 124, the valves 129, 130 and the like, and to install driving components of a plurality of systems for inspection or failure. As a result, the recovery device 104 becomes complex and large in size, and thereby cost of installation is increased. On the other hand, in the BOG processing apparatus 1 of the embodiment in the present invention, the recovery device 5 is constructed with having the ejector 21 in which LNG is the driving medium. Therefore, the structure thereof can be simple, and the configuration of a standby equipment can be reduced without having mechanical moving parts.

Also, the present invention is not limited to the above embodiments. The present invention includes various constitutions in which the object of the present invention can be achieved, and the following modifications are includes in the present invention. For example, in the above embodiment, the BOG processing apparatus 1 installed in a manufacturing equipment of liquefied natural gas (LNG), a storage equipment thereof, a receiving equipment thereof and so on is explained, however the present invention is not limited to liquefied natural gas. The present invention can be used in a manufacturing equipment of any liquefied gas such as liquefied petroleum gas (LPG), liquefied nitrogen, liquefied oxygen, and liquid hydrogen as the BOG processing apparatus.

Further, in the embodiment, the second device 2 having the third spray 15 and the second filled layer 16 are illustrated, however the third spray 15 and the second filled layer 16 are additional things for increasing cooling effect of BOG, and they are not an essential configuration in the present invention. Therefore, they can be omitted as appropriate. Furthermore, the recovery device 5 has the ejector 21 in the embodiment, but the recovery device 5 of the present invention may have a pump like the recovery device 104 before the improvement. In addition, the recovery device 5 has one of the ejector 21 in the embodiment, but the ejector may be provided in each of positions branched into a plurality of systems as the recovery device 104 before the improvement.

Further, the BOG processing apparatus 1 of the embodiment is constructed to return liquid ML to the LNG storage tank by the recovery device 5, but it is not limited to return the recovered liquid to the LNG storage tank as the recovery device. The remaining liquid (or the mixed liquid in which the re-liquefied BOG and LNG are mixed) may be joined to a line sending LNG to the utilizing system. Moreover, the BOG processing apparatus 1 of the embodiment is constructed to compress BOG cooled in the cooling device 2 by the compression device 3, and to send it the utilizing system after cooled in the second cooling device 4, but it is not limited to send BOG cooled in the cooling device 2 to the utilizing system. The BOG processing apparatus 1 may be constructed to re-liquefy almost all of BOG and to discharge the small remaining BOG to the atmosphere via a flare stack. In this case, the compression device 3 and the second cooling device 4 can be omitted.

The best mode configurations, methods and the like for carrying out the present invention are disclosed in the above description, but the present invention is not limited thereto. In the other words, the present invention is illustrated with reference to a specific embodiment, and explained. However, various modifications can be made by those skilled in the art to the above-described embodiments, in shapes, materials, quantities, and other detailed configurations without departing from the technical idea and the scope of the object of the present invention. Thus, descriptions that restrict the shape, material, etc. disclosed above is exemplarily described in order to facilitate understanding of the present invention, and the present invention is not limited thereto. So, descriptions in the name of members excluding a part of the limitation of the shape, material, etc. or all of the limitation are included within the scope of the present invention.

The invention claimed is:

1. A BOG processing apparatus for processing boil-off gas (BOG) generated from liquefied gas in a liquefied gas storage tank comprising:

a cooling device for cooling the BOG by thermal exchange with the liquefied gas; and a recovery device for recovering a remaining liquid of the liquefied gas remaining for use in cooling by the cooling device, or a mixed liquid in which liquid of the BOG cooled and liquefied by the cooling device and the liquefied gas are mixed, wherein the cooling device includes a cooling drum formed in a cylindrical shape extending up and down, and circulating BOG from below to above;

a BOG inlet part introducing the BOG from a lower portion of the cooling drum into an inside of the cooling drum;

a first spray provided above the BOG inlet part and upwardly spraying the liquefied gas;

a first filled layer provided above the first spray and bringing the liquefied gas into contact with the BOG;

a second spray provided above the first filled layer and downwardly spraying the liquefied gas;

a BOG outlet part provided in an upper portion of the cooling drum and sending the BOG cooled;

a liquid outlet part provided in the lower portion of the cooling drum and sending the remaining liquid or the mixed liquid to the recovery device;

a BOG supply line connected to the BOG inlet part and supplying the BOG from the liquefied gas storage tank; and a BOG circulation line connected to the BOG supply line and circulating the BOG to the BOG supply line, wherein the BOG is introduced from the BOG outlet part.

2. The BOG processing apparatus according to claim 1, further comprising a third spray provided above the second spray and downwardly spraying the liquefied gas; a second filled layer provided above the third spray and adsorbing mist in BOG; and a mist eliminator provided above the second filled layer and eliminating mist in BOG passing through the second filled layer, wherein the third spray sprays the liquefied gas with a mist form in which liquid drop is smaller compared to the second spray.

3. The BOG processing apparatus according to claim 1, wherein the recovery device includes an ejection introducing the liquefied gas, drawing the remaining liquid or the mixed liquid by injection pressure of the liquefied gas, and mixing the liquefied gas and the remaining liquid or the mixed liquid and delivering.

4. The BOG processing apparatus according to claim 2, wherein the recovery device includes an ejection introducing the liquefied gas, drawing the remaining liquid or the mixed liquid by injection pressure of the liquefied gas, and mixing the liquefied gas and the remaining liquid or the mixed liquid and delivering.

5. The BOG processing apparatus according to claim 1, wherein the first spray and the second spray spray the liquefied gas to the first filled layer, and the liquefied gas is spread on the top and the bottom of the first filled layer.

6. The BOG processing apparatus according to claim 1, wherein the first filled layer is constructed by one filled with a metal forming ring or one formed by overlapping a net-like molded body made of metal, and the height dimension of the first filled layer is 600 mm.

7. The BOG processing apparatus according to claim 2, wherein the first filled layer and the second filled layer is constructed by one filled with a metal forming ring or one formed by overlapping a net-like molded body made of metal, and the size of the metal forming ring or mesh of the net-like molded body of the second filled layer is smaller than those of the first filled layer.

8. The BOG processing apparatus according to claim 7, the height dimension of the first filled layer is 600 mm.

9. The BOG processing apparatus according to claim 2, wherein no sprays spraying the liquefied gas is provided above the second filled layer.

10. The BOG processing apparatus according to claim 1, further comprising a storage part provided between the BOG outlet part and the liquid outlet part and store the remaining liquid or the mixed liquid.

11. The BOG processing apparatus according to claim 1, further comprising:

a liquefied gas supply line connected to the first spray and the second spray and supplying the liquefied gas from the liquefied gas storage tank; and a liquid return line connected to the recovery device and returning the remaining liquid or the mixed liquid to the liquefied gas storage tank.

* * * * *